US011607699B2

(12) United States Patent
Fore et al.

(10) Patent No.: US 11,607,699 B2
(45) Date of Patent: Mar. 21, 2023

(54) AEROSOL LOCKOUT MECHANISM

(71) Applicant: PRECISION VALVE CORPORATION, Greenville, SC (US)

(72) Inventors: John B. Fore, Travelers Rest, SC (US); Michael Paul Downey, Greer, SC (US); Matthew L. Brett, Toronto (CA)

(73) Assignee: Precision Valve Corporation, Greenville, SC (US)

( * ) Notice: Subject to any disclaimer, the term of this patent is extended or adjusted under 35 U.S.C. 154(b) by 0 days.

(21) Appl. No.: 17/538,110

(22) Filed: Nov. 30, 2021

(65) Prior Publication Data

US 2022/0168765 A1 Jun. 2, 2022

Related U.S. Application Data

(60) Provisional application No. 63/119,251, filed on Nov. 30, 2020.

(51) Int. Cl.
*B05B 11/00* (2006.01)

(52) U.S. Cl.
CPC ..... *B05B 11/3057* (2013.01)

(58) Field of Classification Search
CPC ..... B05B 11/3057; B65D 83/22; B65D 83/24; B65D 83/206
See application file for complete search history.

(56) References Cited

U.S. PATENT DOCUMENTS

| | | | | |
|---|---|---|---|---|
| 5,716,008 A * | 2/1998 | Nottingham | ..... | B05B 11/3045 222/333 |
| 2007/0023457 A1* | 2/2007 | O'Toole | ..... | B65D 83/206 222/402.13 |
| 2018/0118444 A1 | 5/2018 | Bodet et al. | | |
| 2022/0168765 A1* | 6/2022 | Fore | ..... | B05B 11/3057 |

FOREIGN PATENT DOCUMENTS

| | | | | |
|---|---|---|---|---|
| CN | 101585437 A * | 11/2009 | ..... | B05B 11/0027 |
| CN | 103879679 A * | 6/2014 | | |
| JP | H02-008564 U | 1/1990 | | |
| JP | 2002-302175 A | 10/2002 | | |
| JP | 2004-025047 A | 1/2004 | | |
| JP | 2005-320015 A | 11/2005 | | |
| JP | 2006-089091 A | 4/2006 | | |
| JP | 2007-284070 A | 11/2007 | | |
| JP | 2007-331786 A | 12/2007 | | |
| JP | 2007331786 A * | 12/2007 | | |
| JP | 2008-001385 A | 1/2008 | | |
| JP | 4097904 B2 | 3/2008 | | |

(Continued)

OTHER PUBLICATIONS

Aerosol Industry Association of Japan, Safety Disposing Pamphlet, Jul. 26, 2010, with machine translation.

(Continued)

*Primary Examiner* — Bob Zadeh
(74) *Attorney, Agent, or Firm* — Ruggiero McAllister & McMahon LLC

(57) ABSTRACT

An actuator for a valve is lockable with a tubular member to maintain the valve in either an actuated position or in an unactuated position. Locked in the actuated position, degassing can occur. Locked in the unactuated position, inadvertently dispensing of product is prevented.

12 Claims, 4 Drawing Sheets

(56) References Cited

FOREIGN PATENT DOCUMENTS

| | | | |
|---|---|---|---|
| JP | 4408875 | B2 | 11/2009 |
| JP | 4523811 | A | 6/2010 |
| JP | 4545567 | B2 | 7/2010 |
| JP | 2010-274232 | A | 12/2010 |
| JP | 2010-275002 | A | 12/2010 |
| JP | 4889996 | B2 | 12/2011 |
| JP | 4901322 | B2 | 1/2012 |
| JP | 4964510 | B2 | 4/2012 |
| JP | 5213617 | B2 | 3/2013 |

OTHER PUBLICATIONS

International Search Report dated Feb. 15, 2022 from International Patent Application No. PCT/US2021/061142, 3 pages.
Written Opinion dated Feb. 15, 2022 from International Patent Application No. PCT/US2021/061142, 11 pages.

* cited by examiner

AEROSOL LOCKOUT MECHANISM

CROSS-REFERENCE TO RELATED APPLICATIONS

This application claims the benefit of U.S. Provisional Application Ser. No. 63/119,251, filed Nov. 30, 2020, the entire contents of which are incorporated by reference herein.

BACKGROUND

1. Field of the Disclosure

The present disclosure relates to a lockout mechanism used in an aerosol product dispensing system. More particularly, the present disclosure relates to such a lockout mechanism that locks an actuator in one position to prevent actuation of a valve and locks the actuator in a second position to maintain actuation of the valve so that degassing can occur.

2. Description of Related Art

Aerosol systems dispense a variety of products from a pressurized container. Products include paint, solvents, food, healthcare products, and chemicals. First, inadvertent actuation of an aerosol container has been a longstanding industry problem. Such inadvertent actuation clearly minimizes the contents of the container. Thus, conventional systems have used a mechanism to lock the actuator to prevent inadvertent actuation. Such present lock mechanisms have had modest success.

Second, disposal of such containers can be hazardous waste, explosive, and have ignitability, if the container is not empty. For example, the containers can still have propellant or product therein. Thus, safe environmental disposal requires degassing to occur. Presently, such degassing is achieved by simply manually holding the actuator open to degas.

Thus, there is a need for a lockout mechanism that achieves both locks effectively. Moreover, there is a need for virtually a single lockout mechanism that can be used interchangeably for both locks.

SUMMARY

The present disclosure provides a single lockout mechanism that achieves locking to avoid inadvertent use and also locking for desired degassing.

The present disclosure also provides such a single lockout mechanism that is adjusted in a first position to be lockable to prevent inadvertent actuation of a valve and in a second or readjusted position to be lockable to maintain actuation of the valve so that degassing can occur.

The present disclosure thus provides such a single lockout mechanism that achieves both locks without the needed for a second lockout mechanism.

BRIEF DESCRIPTION OF THE FIGURES

The accompanying drawings illustrate aspects of the present disclosure, and together with the general description given above and the detailed description given below, explain the principles of the present disclosure. As shown throughout the drawings, like reference numerals designate like or corresponding parts.

DETAILED DESCRIPTION

Figure 1:
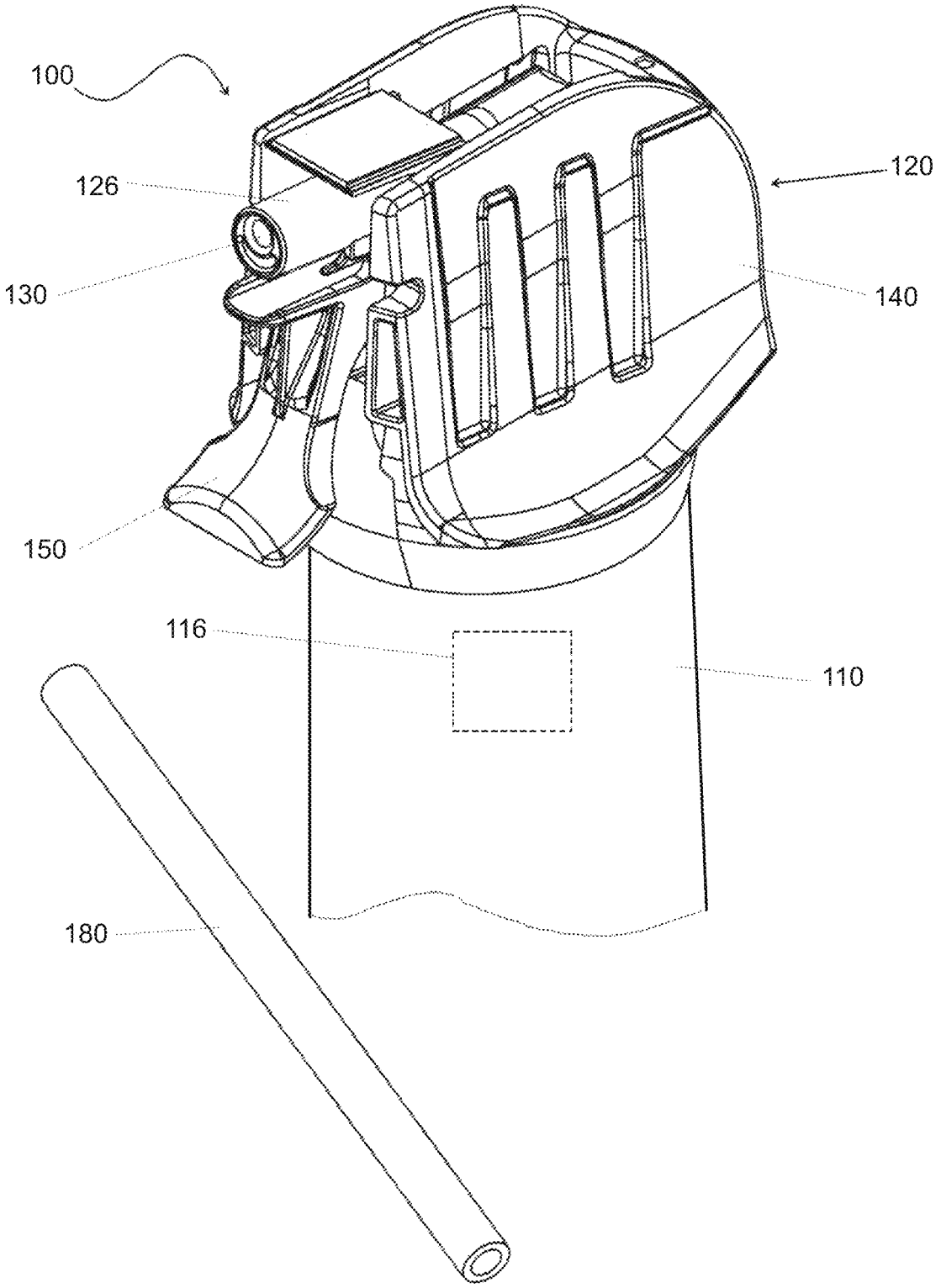
FIG. 1 is a perspective view of an dispensing system with an actuator lockout mechanism according to the present disclosure.

Referring to the drawings, and in particular to FIG. 1, a dispensing system according to the present disclosure is shown and generally referenced by reference numeral 100. System 100 includes a container 110 of product to be dispensed that is under pressure, a valve 116 such as an aerosol valve, and an actuator 120. Valve 116 operatively connects container 110 to actuator 120 so that the actuator actuates the valve to allow product to be discharged.

Actuator 120 includes a body 126, a conduit 130 disposed through the body, a shroud 140, and a trigger or trigger member 150. Actuator 120 can be a single molded component. Actuator 120 toggles actuation of valve 116 between a first or closed or lock position shown in FIGS. 2 to 5 and a second or open or degas position shown in FIGS. 6 and 7.

The present disclosure provides a lockout mechanism or structure that can be adjusted to lock actuator 120 in the open position to enable degassing with a tubular member 180 and can also be adjusted or readjusted to lock actuator 120 in the closed position to prevent product from being discharged with tubular member 180.

Figure 2:
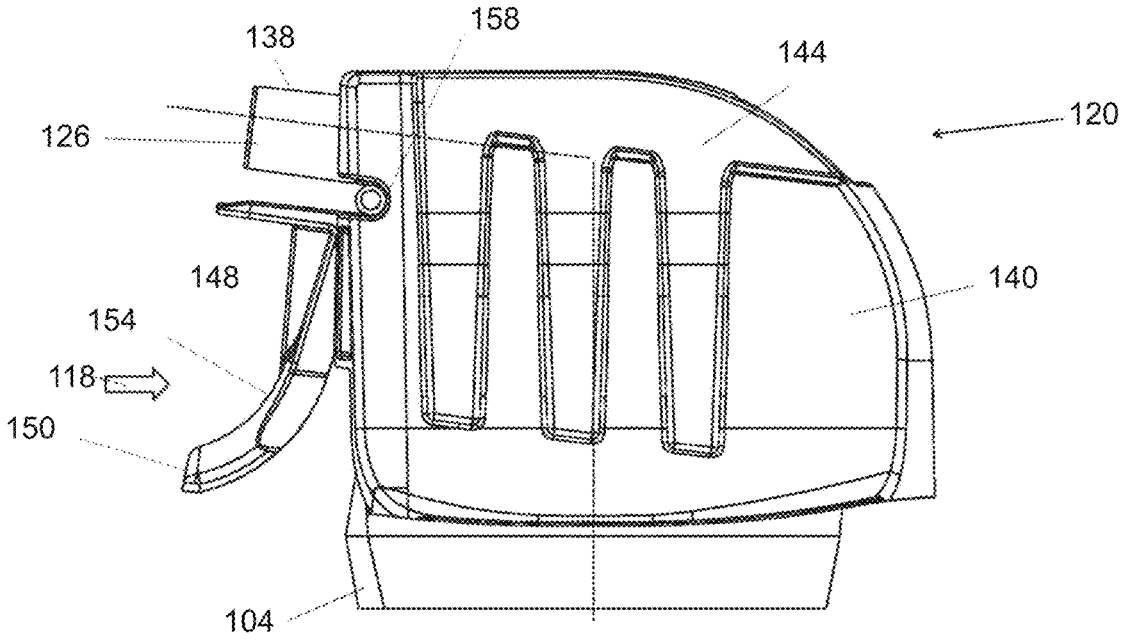
FIG. 2 is a side view of the actuator shown in FIG. 1 in a closed, lock position.
Figure 3:
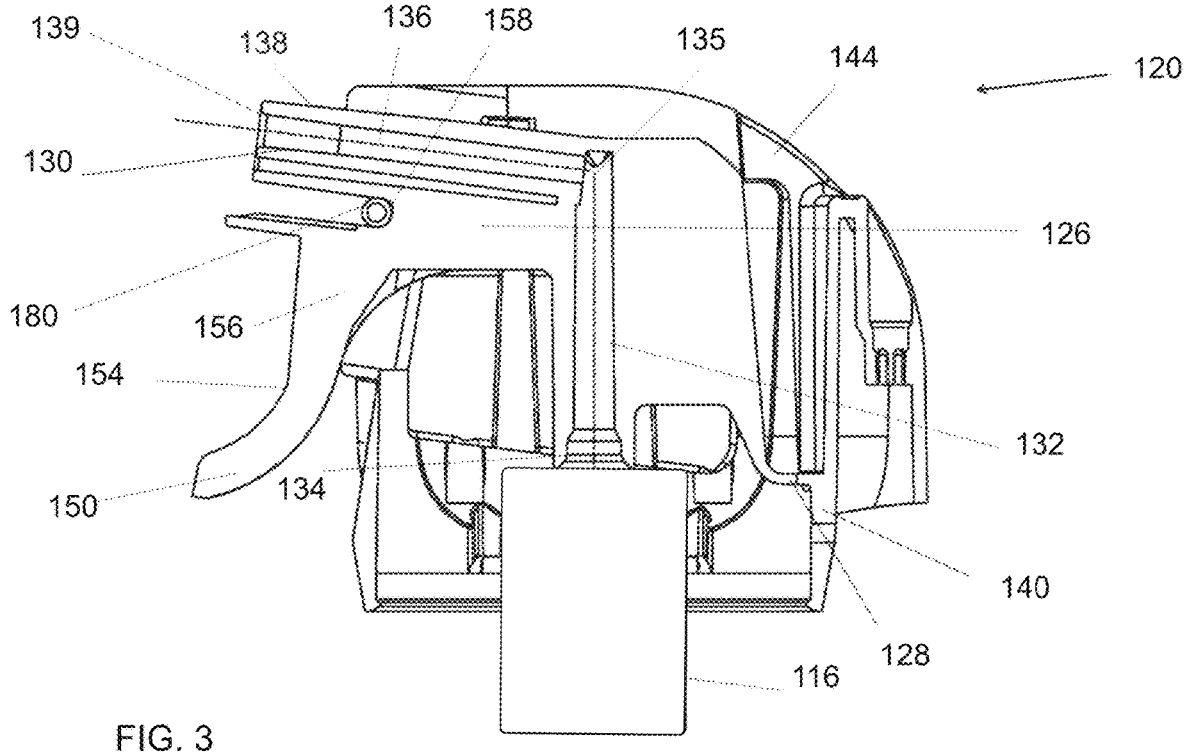
FIG. 3 is a cross-sectional view of the actuator of FIG. 2 in a closed, lock position.

Referring to FIGS. 2 and 3, a side and a cross-sectional view of actuator 120 in a closed, lock position are shown, respectively.

Body 126 can be a wall defining conduit 130 therethrough. In examples, body 126 can include a pair (not shown) of sidewalls 156 that each have a slot so that slot 158 can be two slots. Body 126 is connected to shroud 140 by a hinge 128.

In such examples, hinge 128 can be a living hinge which is an integrally formed flexure bearing hinge made of the same material as body 126 and shroud 140.

Conduit 130 has a vertically extending or first portion 132, and a horizontally extending or second portion 136. First portion 132 and second portion 136 connect at a joint or juncture 135. At a lower end opposite joint 135, first portion 132 has a socket 134 for operably receiving and cooperating with valve 116.

Second portion 136 has a top surface 138. At an end opposite joint 135, second portion 136 has a nozzle or exit orifice 139.

Trigger 150 is preferably a finger-engageable trigger member connected to body 126. Trigger 150 has a finger surface 154 and a side wall 156. Side wall 156 is provided with a slot 158 for receiving a tubular member 180. Slot 158 is preferably a single slot.

Trigger 150 moves linearly upon finger engagement and disengagement and acts upon valve 116. When force is applied as indicated by arrow 118, valve 116 opens. Release of trigger 150 together with bias from valve 116 causes the valve to close. Thus, conduit 130 conveys product from container 110 (FIG. 1) through exit orifice 139 by a pressure differential caused by actuation of valve 116 by trigger 150.

Figure 4:
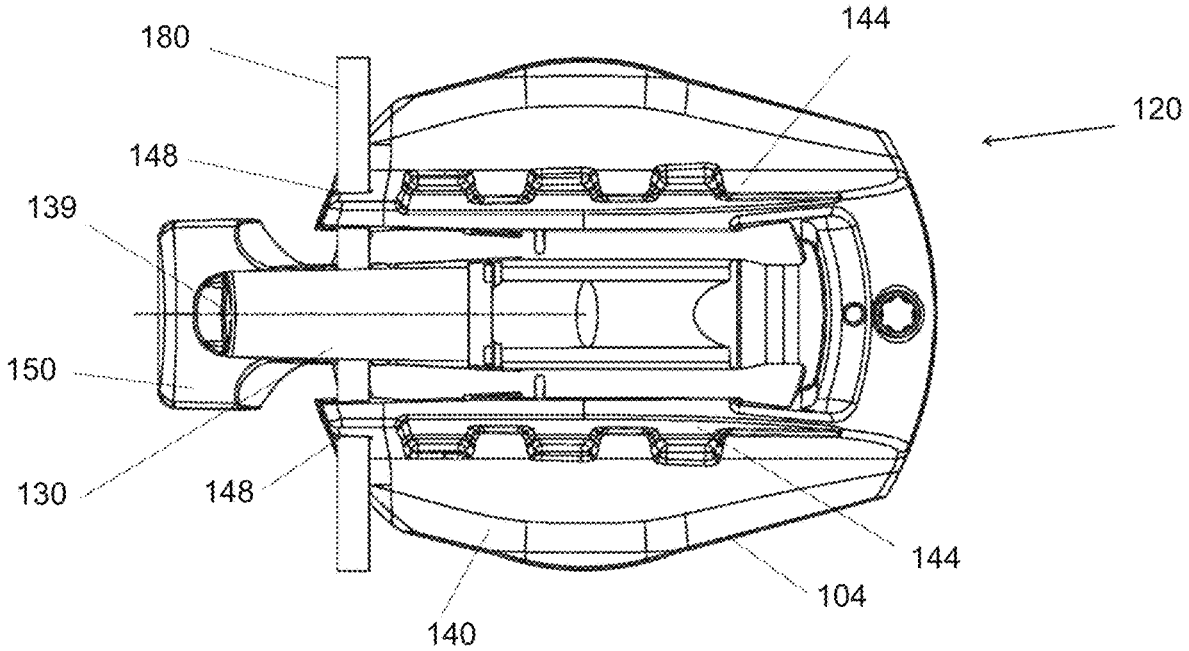
FIG. 4 is a top view of the actuator of FIG. 2 in a closed, lock position.

Referring to the top view of actuator 120 shown in FIG. 4, shroud 140 has a base 104 mountable on container 110 or a mounting cup (not shown) of the container. Shroud 140 also has a top and side walls 144 that enclose portions of conduit 130 and trigger 150. Each side wall 144 is provided with a slot 148 for receiving tubular member 180.

It is envisioned that the external appearance and shape of shroud 140 can be round, rectangular, and have various geometries other than those shown.

Figure 5:
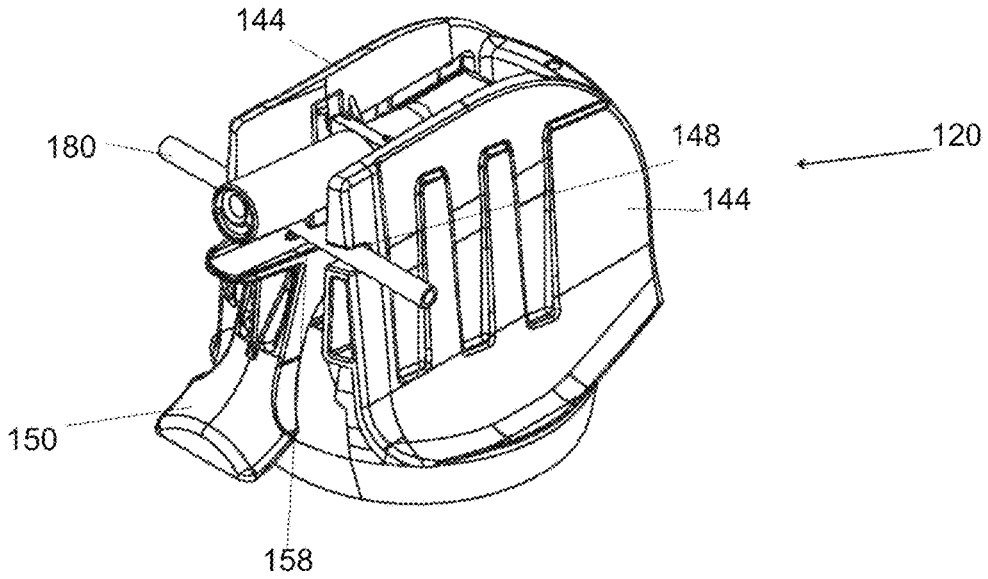
FIG. 5 is a perspective view of the actuator of FIG. 2 in a closed, lock position.

Referring to FIG. 5, the first or closed or lock position is shown. For the lockout in this position, the pair of slots 148 of side walls 144 and slot 158 in trigger 150 are aligned. Tubular member 180 is inserted through slots 148 and slot 158. Accordingly, tubular member 180 interferes with actuation of trigger 150 so that accidental discharge of product is prevented.

Figure 6:
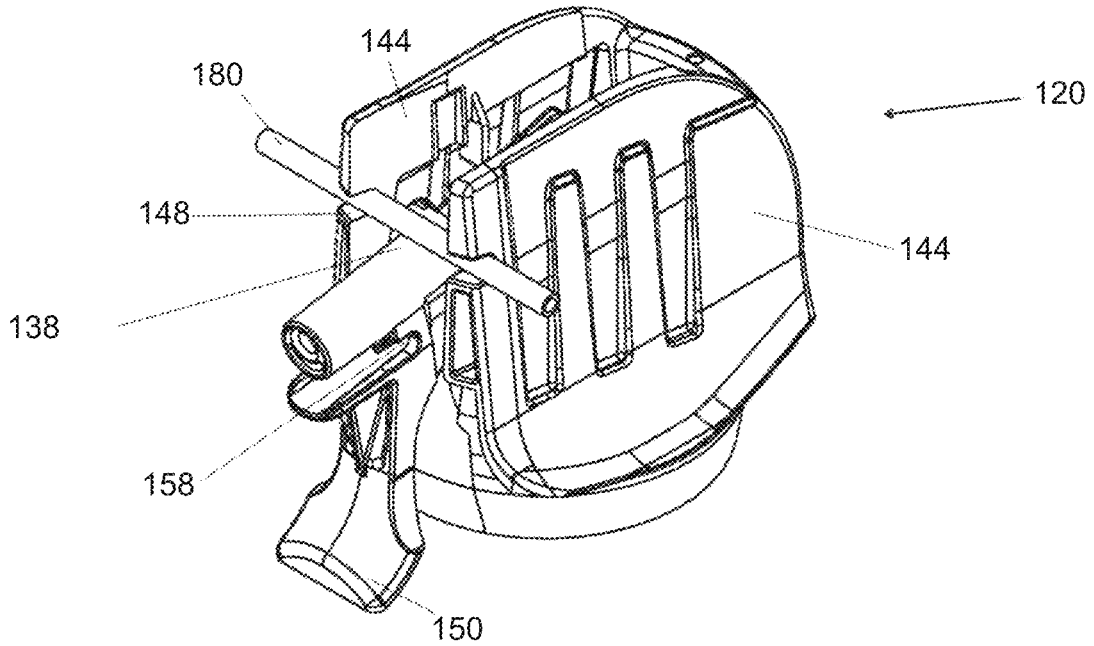
FIG. 6 is a perspective view of the actuator of FIG. 2 in an open, degas position.
Figure 7:
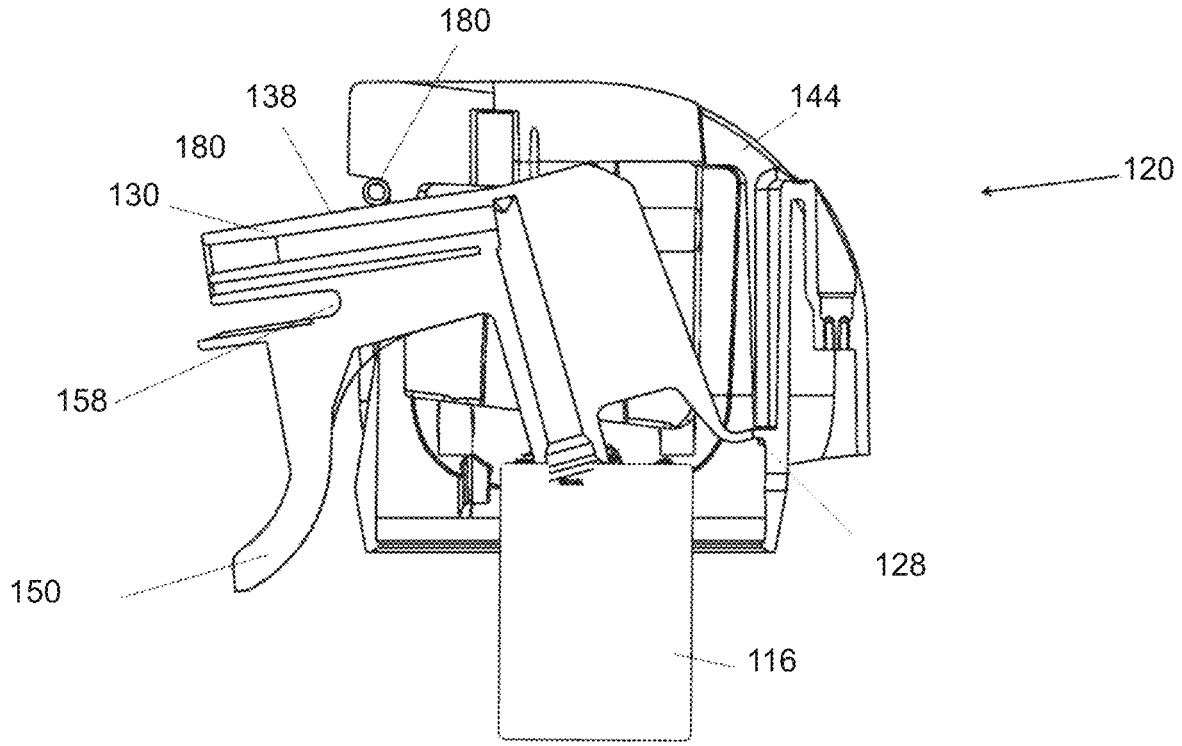
FIG. 7 is a cross-sectional view of the actuator of FIG. 2 in an open, degas position.

Referring to FIGS. 6 and 7, the second or open or degas position is shown. To effect this position, a user engages trigger 150 and actuates or opens 116 valve. Tubular member 180 is inserted in the pair of slots 148 of side walls 144 and disposed above top surface 138. Upon release or disengagement of trigger 150, tubular member 180 interferes with top surface 138 to prevent the valve from closing. Accordingly, container 110 can be completely degassed.

The open position of FIGS. 6 and 7 can, but need not, be a fully open position of valve 116. For example, valve 116 can be at least 25% open, at least 50% open, or at least 75% open. In other examples, valve 116 can be open from 70% to 100%, from 75% to 95%, and/or from 80% to 90%, including all sub ranges therebetween. By limiting percent opening, the rate of degassing can be controlled.

In effect, slots 148 of pair of side walls 144 of shroud 140 and slot 158 of body 126 along with tubular member 180 and top surface 138 comprise the lockout mechanism. This lockout mechanism is effective with actuator 120 due to the movement of the actuator from first or closed or lock position shown in FIGS. 2 to 5 to second or open position shown in FIGS. 6 and 7 and resulting alignments of slots 148 and slot 158 and slots 148 and top surface 138.

Tubular member 180 is preferably rigid. Alternatively, tubular member 180 is semi-rigid so that there is no or minimal flexion when positioned through slots 148 and 158. Advantageously, even if there is some flexion, valve 116 is held at least partially open to enable complete degassing.

In alternate embodiments, nozzle 139 can be located at joint 135 and oriented to dispense along axis 102, without fluid communication to second portion 136 so that second portion 136 serves only as a lever. In this embodiment, product is discharged vertically.

Each slot 148 of each side wall 144 of shroud 140 can instead be a hole. Further, each slot 148 can be a ledge or groove. Each slot 148 is preferably a slot since it is simpler to insert tubular member 180 therein. It is also preferred that each slot 148 has enough depth to receive the entire circumference of tubular member 180 therein.

It is also understood that tubular member 180 can possibly have an oval, round, square or rectangular shape. The actual shape of tubular member 180 can vary slightly as long as tubular member 180 and slots 148, as well as slot 158, can readily receive and subsequently release tubular member 180.

While the present disclosure has been described with reference to one or more exemplary embodiments, it will be understood by those skilled in the art, that various changes can be made, and equivalents can be substituted for elements thereof without departing from the scope of the present disclosure. Therefore, it is intended that the present disclosure will not be limited to the particular embodiments disclosed herein.

The invention claimed is:

1. An actuator for a valve operable to spray fluid from a dispenser, the actuator being lockable with a member to maintain the valve in either an actuated position or in an unactuated position, the actuator comprising:

a shroud having a base mountable on the dispenser, the shroud having a pair of walls that extend vertically, each wall of the pair having a shroud slot that is sized to receive the member therethrough, wherein the shroud slots are horizontally aligned with each other;

a trigger member operable to actuate the valve, the trigger member having a trigger slot sized to receive the member therethrough;

a conduit defined by an outer wall, the outer wall being connected to the trigger member, the conduit having a portion extending horizontally from a proximal end of the conduit and a portion extending vertically from a distal end of the conduit, the proximal end having an orifice, the distal end being in fluid communication with the valve; and a hinge connecting the outer wall and the shroud, wherein the member is insertable through each of the shroud slots and the trigger slot to prevent actuation of the valve and the member is insertable through each of the shroud slots to contact a top surface of the horizontal portion to secure the valve in the actuated position.

2. The actuator of claim 1, wherein the actuated position is configured so that valve is at least 50% open.

3. The actuator of claim 2, wherein the actuated position is configured so that valve is from 70% to 100% open.

4. The actuator of claim 1, wherein the actuator is a one-piece molded construction.

5. The actuator of claim 1, wherein the member is a tubular member.

6. The actuator of claim 1, wherein the trigger member is a finger.

7. A dispensing system, the system comprising:

a tubular member;

a pressurized container operable by a valve;

a shroud having a base mountable on the dispenser, the shroud having a pair of walls that extend vertically, each wall of the pair having a shroud slot that is sized to receive the tubular member therethrough, wherein the shroud slots are horizontally aligned with each other;

a trigger member that is finger operable to actuate the valve, the trigger member having a trigger slot sized to receive the tubular member therethrough;

a conduit defined by an outer wall, the outer wall being connected to the trigger member, the conduit having a portion extending horizontally from a proximal end of the conduit and a portion extending vertically from a distal end of the conduit, the proximal end having an orifice, the distal end being in fluid communication with the valve; and a hinge connecting the outer wall and the shroud, wherein the tubular member is insertable through each of the shroud slots and the trigger slot to prevent actuation of the valve and the tubular member is insertable through each of the shroud slots to contact a top surface of the horizontal portion to secure the valve in an actuated position.

8. The actuator of claim 7, wherein the actuated position is configured so that valve is at least 50% open.

9. The actuator of claim 8, wherein the actuated position is configured so that valve is from 70% to 100% open.

10. The actuator of claim 7, wherein the actuator is a one-piece molded construction.

11. The actuator of claim 7, wherein the tubular member is rigid.

12. The actuator of claim 7, wherein the tubular member has a cross-sectional shape selected from the group consisting of: round, square, oval, rectangular.

* * * * *